United States Patent [19]

Pesthy

[11] Patent Number: 4,634,119

[45] Date of Patent: Jan. 6, 1987

[54] RESILIENT EXERCISE MACHINE WITH BODY SUPPORT PLATFORM

[76] Inventor: Paul K. Pesthy, 203 Greenlawn St., San Antonio, Tex. 78201

[21] Appl. No.: 753,884

[22] Filed: Jul. 11, 1985

[51] Int. Cl.[4] ..... A63B 21/00; A63B 21/04

[52] U.S. Cl. ..... 272/144; 272/136; 272/142; 272/134; 272/145

[58] Field of Search ..... 272/116–145

[56] References Cited

U.S. PATENT DOCUMENTS

| | | | |
|---|---|---|---|
| 955,793 | 4/1910 | Harris | 272/142 |
| 3,397,884 | 8/1968 | Blasi . | |
| 3,524,644 | 8/1970 | Kane . | |
| 3,558,131 | 1/1971 | Dragon . | |
| 3,664,666 | 5/1972 | Lloyd . | |
| 3,770,267 | 11/1973 | McCarthy . | |
| 3,985,354 | 10/1976 | Schulkin | 272/134 |
| 4,098,502 | 7/1978 | Faust | 272/144 |
| 4,231,568 | 11/1980 | Riley et al. | 272/136 |
| 4,241,914 | 12/1980 | Bushnell | 272/136 |
| 4,383,684 | 5/1983 | Schliep | 272/145 X |
| 4,407,495 | 10/1983 | Wilson | 272/134 |
| 4,422,636 | 12/1983 | DeAngeli | 272/134 X |

FOREIGN PATENT DOCUMENTS

| | | | |
|---|---|---|---|
| 2065482 | 7/1981 | United Kingdom | 272/134 |

OTHER PUBLICATIONS

Keiser, Athletic Journal, Nov. 1982, (inside front cover).

*Primary Examiner*—Richard J. Apley
*Assistant Examiner*—John L. Welsh
*Attorney, Agent, or Firm*—Cox & Smith Inc.

[57] ABSTRACT

An exercise machine having a frame and a T-bar unit and a vertical resistance unit pivotally mounted to the frame for performance of variable resistance exercises. The vertical resistance unit is provided with uprights and a horizontal bar. Springs are provided to resist the extension of the vertical resistance unit by pushing or pulling the horizontal bar in the vertical direction and to resist the pivoting of the T-bar unit, thereby providing the benefit of the maximum resistance to the movement of the muscle group to the user.

13 Claims, 11 Drawing Figures

RESILIENT EXERCISE MACHINE WITH BODY SUPPORT PLATFORM

BACKGROUND OF THE INVENTION

The present invention relates to an exercise machine for developing and toning the muscles. More particularly, it is directed to an exercise machine which is compact, easy to use and provides resistance throughout the full range of movement of the muscle group being exercised.

Exercise physiologists believe that the most beneficial type of weigthlifting machines are those which provide variable resistance through the full range of movement of the muscle group. Variable resistance exercise machines provide a maximum amount of resistance throughout the full range of the exercise, whereas the resistance applied during conventional free weightlifting is limited to the maximum amount that can be moved at the weakest angle of the movement. Consequently, only the range of movement at the weakest angle is loaded to maximum levels while the strongest range of movement never receives a maximum load. Variable resistance exercise machines provide a changing resistance throughout the range of the movement so that the muscles are loaded at their maximum capability during the entire movement.

However, most variable resistance exercise machines are highly specialized machines, which are quite elaborate and expensive. Further, they are normally large in size and weight, offering little or no portability. For instance, perhaps the best known and most popular variable resistance machines are those marketed under the brand name "NAUTILUS". There are perhaps twenty different NAUTILUS machines which the exerciser must use to get a complete workout, the smallest of which is about 4 feet by 4 feet by 5 feet in size and which weighs about sixty pounds, and which is not capable of being folded for transport. Further it can be used for one or two exercises only. Many attempts have been made to develop variable resistance exercise machines which are lighter and more portable, but to date, most attempts have been unsatisfactory in that they have resulted in exercise machines which are capable of only a limited number of exercises.

The present invention overcomes the limitations of the those previous exercise machines by providing a lightweight, portable variable resistance exercise machine which is capable of being used for a large variety of exercises. It is, therefore, an object of the present invention to provide an exercise machine capable of providing the maximum resistance to movement of the muscle group throughout the entire group of movement. Another object of the present invention is to provide an exercise machine capable of being used by several muscle groups engaged in several different exercises.

Another object of the present invention is to provide a variable resistance exercise machine which is inexpensive and which occupies comparatively little space. Another object of the present invention is to provide a lightweight variable resistance exercise machine which is capable of providing the maximum resistance during movement of several different muscle groups.

Another object of the present invention is to provide a variable resistance exercise machine which is easy to assemble and to operate, and therefore, easily transported, and which is capable of being used for several exercises.

Other objects of the present invention will be apparent to those skilled in the art from the following detailed description.

SUMMARY OF THE INVENTION

These objectives are achieved in the present invention by providing an exercise machine comprising an elongated frame having a first platform mounted on it and a second platform pivotally mounted thereto. The second platform is operable to pivot between a first horizontal position and a second upright position. A T-bar unit is pivotally mounted to one end of the frame and comprises a means operable to support the second platform when in the second upright position, a support bracket having a pulley rotatably mounted thereon, and a roller rotatably mounted on the support bracket. Resistance means having a free end and an end mounted to the frame is also provided, the resistance means engaging the pulley of the T-bar unit and being operable to provide resistance to the movement of the free end of the resistance means. An upright having first and second portions in telescoping relationship is pivotally mounted to the frame, and a first horizontal bar adjustably engages the upright at a selected point along its length. A second horizontal bar is provided which is integral with the upright, and means operable to resist the extension of the first portion of the upright out of the second portion of the upright in telescopic fashion is also provided.

DETAILED DESCRIPTION OF THE INVENTION

Figure 1:
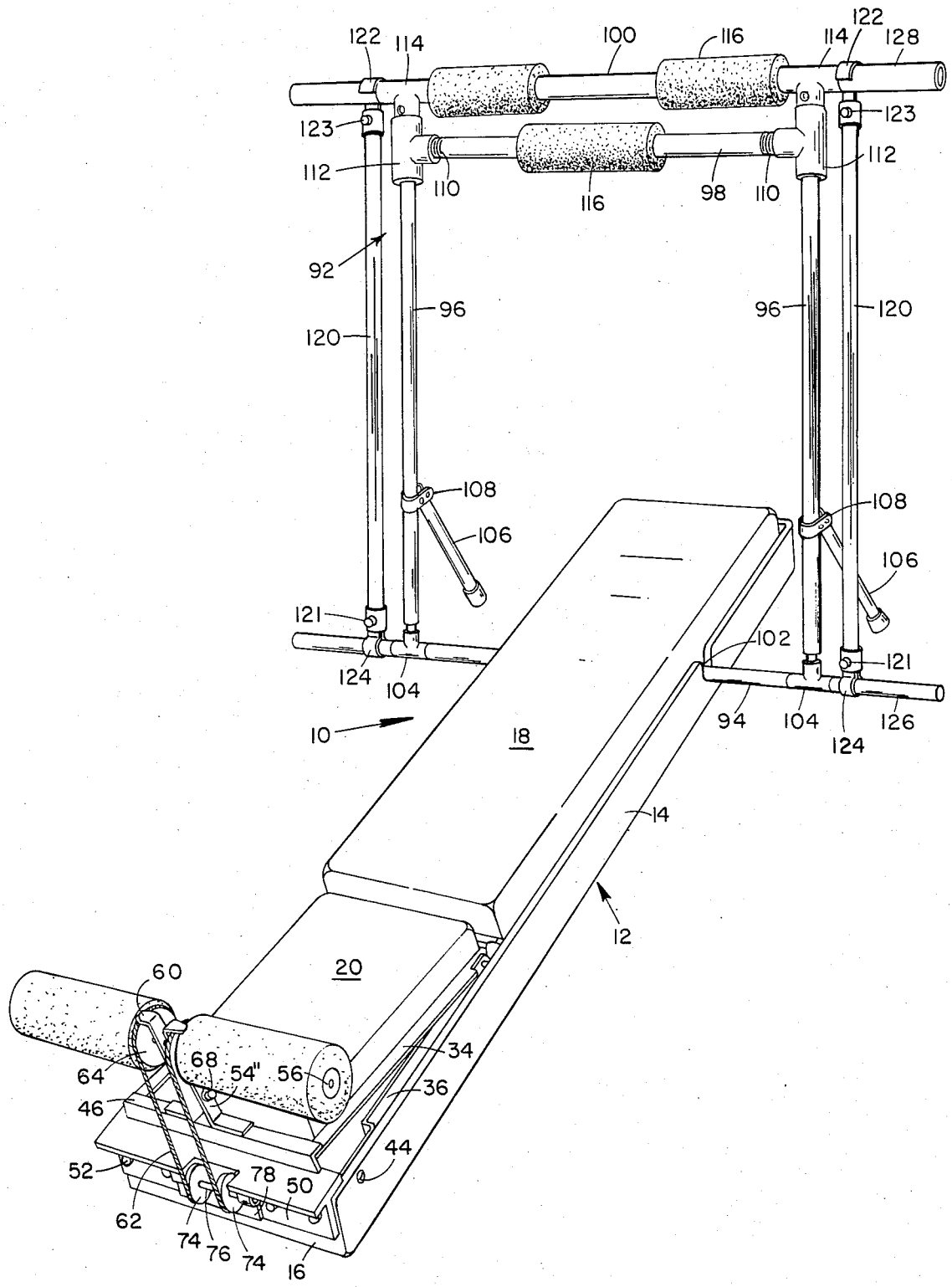
FIG. 1 is a perspective view of a presently preferred embodiment of the invention.

Referring to FIG. 1, there is shown an exercise machine 10, constructed according to the present invention. The exercise machine is comprised of a frame 12 having a longitudinal member 14 on each side and a cross member 16 at each end. As shown in FIG. 3, a first platform 18 is provided of appropriate size to fit within the frame 12. A second platform 20 is also provided to fit within the frame 12, in end-to-end relationship with the first platform 18. The first platform 18 rests upon longitudinal stringers 22 within the frame 12, and the second platform 20 is pivotally mounted to the longitudinal stringers 22 on axle 24. Axle 24 is held to the longitudinal stringer 22 by a D-strap 26, which is bolted to the longitudinal stringer 22 by bolts 28. Cross stringer 30 is provided for additional rigidity and support, as shown in FIG. 2.

Figure 2:
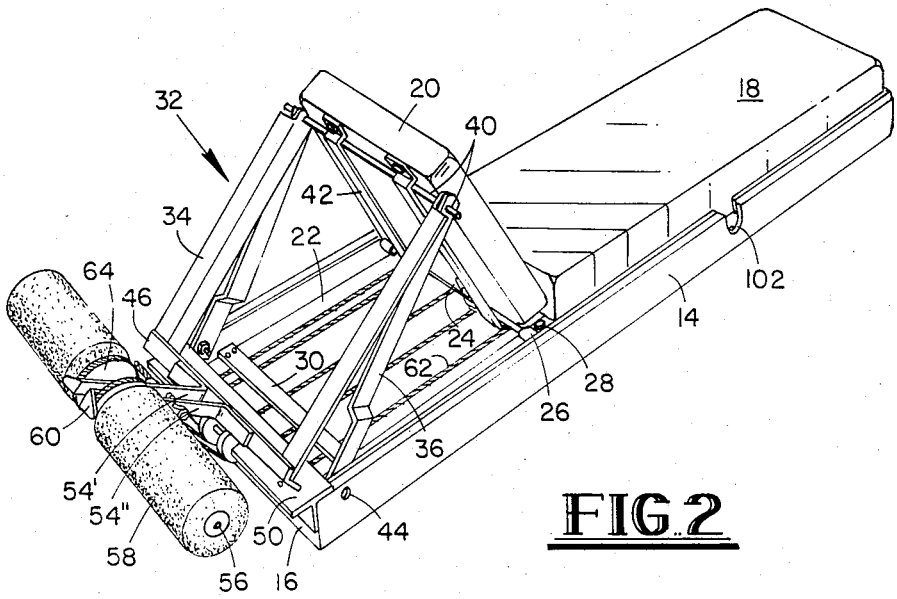
FIG. 2 is a perspective view of the apparatus shown in FIG. 1 with the vertical resistance unit removed and the second platform in its upright position.
Figure 3:
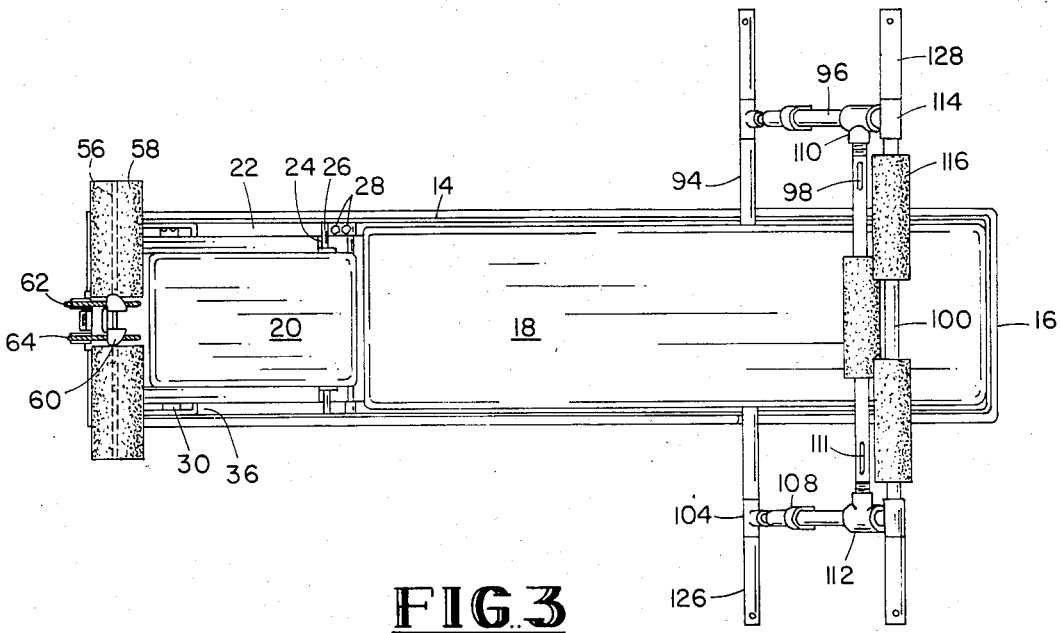
FIG. 3 is a top view of the apparatus shown in FIG. 1.
Figure 4:
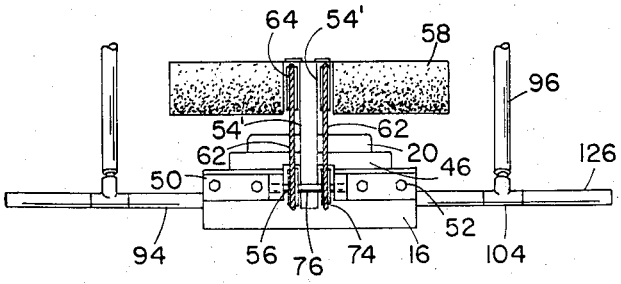
FIG. 4 is an end-view of the apparatus shown in FIG. 1 with the vertical resistance unit being partially broken away.
Figure 7A:
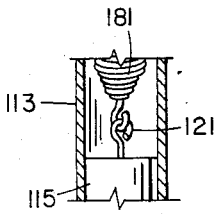
FIG. 7A is a cross sectional view similar to FIG. 7 through a portion of the vertical resistance unit showing the attachment of the upper and lower portions of the vertical resistance unit in enlarged detail.
Figure 6:
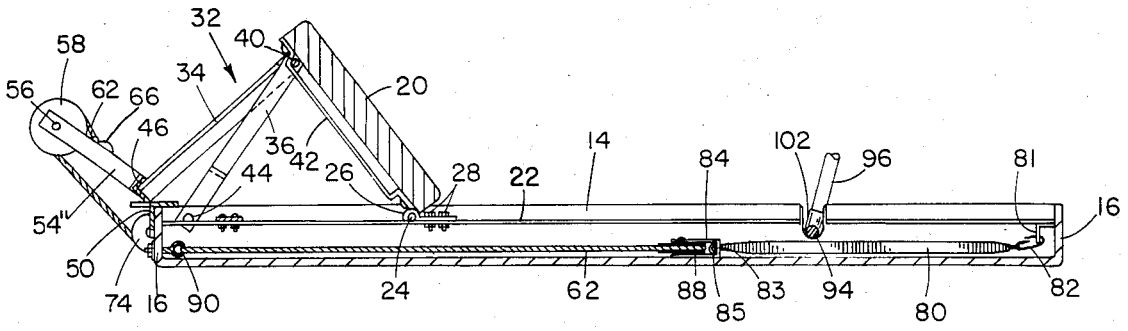
FIG. 6 is a longitudinal sectional view of the apparatus shown in FIG. 1 with the second platform in its upright position and the vertical resistance unit partially broken away.

A T-bar unit, indicated generally at reference numeral 32, is provided at one end of the frame 12 (See FIGS. 2 and 6). The T-bar unit 32 is comprised of support frame members 34 and support bars 36, which are joined at one end by axle 40 which projects through both the support frame member 34 and the support bar 36. The axle 40 slides back and forth within the space created by the underside of second platform 20 and the runners 42 which are fixed thereto. As shown in FIG. 2, the support bars 36 are pivotally bolted to the longitudinal member 14 of frame 12 by bolts 44. The support frame members 34 are integral with support frame cross member 46, and support frame cross member 46 normally rests on plate 50. The plate 50 is bolted to the cross member 16 by bolts 52, shown in FIG. 4. As second platform 20 is raised from the horizontal position shown in FIG. 1 to the upright position shown in FIGS. 2 and 6, support frame member 36 is pivoted on bolts 44 and axle 40 slides upwardly inside the runners 42 to the position shown in FIGS. 2 and 6.

The final part of the T-bar unit 32 is formed by the T-bar 54, which is actually comprised of two L-shaped bars as denoted at 54' and 54". The T-bar 54 is provided with an axle 56 (shown in FIG. 2 and in shadow lines in FIG. 3) which projects through the holes (not numbered) in the T-bar 54. Rollers 58 are mounted on the axle 56 for rotation as the user's feet are hooked underneath the rollers 58 and the support frame member 34 and T-bar 54 is lifted upwardly, as will be described. The axle 40 allows this pivoting of the support frame member 34 in an arc as the user lifts up on the bottom side of the rollers 58.

Figure 5:
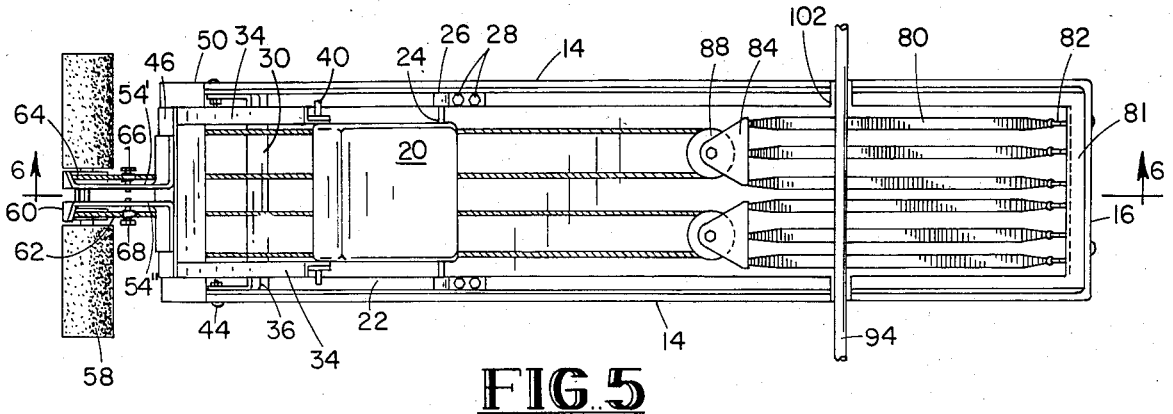
FIG. 5 is a top view of the apparatus shown in FIG. 1 with the first platform removed and the vertical resistance unit being partially broken away.
Figure 8:
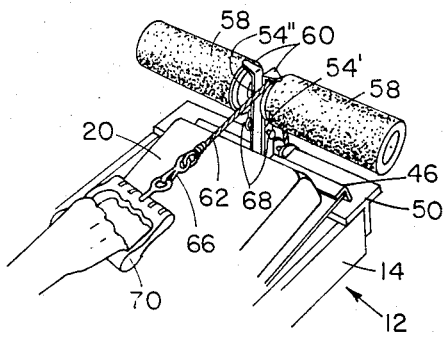
FIG. 8 is a perspective view of the T-bar unit pivotally mounted at one end of the apparatus shown in FIG. 1 showing a hand grip detachably mounted on the end of one of the cables shown in the apparatus of FIG. 1.
Figure 9:
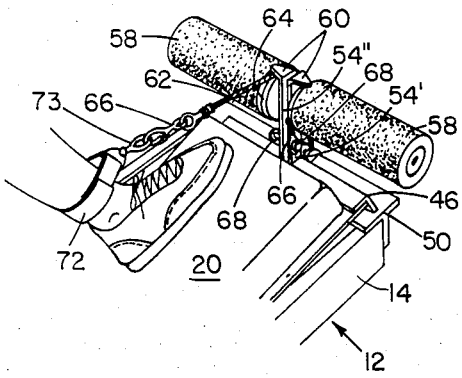
FIG. 9 is a perspective view of the T-bar unit pivotally mounted at one end of the apparatus shown in FIG. 1 showing a cuff detachably mounted on the end of one of the cables of the apparatus of FIG. 1 for engagement of the leg.

As shown best in FIGS. 1 and 3, the T-bars 54' and 54" are also provided with a flange 60 which acts as a guard to help keep the cable 62 on pulleys 64 which are also mounted on axle 56. The flange 60 also protects the user and items of the user's loose clothing from being caught between the cable 62 and the pulley 64 as the rollers 58 and pulleys 64 rotate. A clip 66, shown in FIG. 8, is provided on the free end of the cable 62 for attachment to one of the catches 68 (see FIGS. 5 and 6) on the T-bars 54 when the cable 62 is not in use, or for attachment to a handgrip 70 or cuff 72 (FIG. 1) as shown in FIGS. 8 and 9. When the free ends of cables 62 are attached to catches 68, resistance against the exertion of upward force underneath the rollers 58 will be provided by springs 80 as will be described. As rollers 58 are moved upwardly by the user, support frame members 34 and support frame cross-member 46 are likewise rotated upwardly. The cable 62 may also be pulled upwardly when a handgrip 70 or cuff 72 is attached to the clip 66 and the user pulls on the handgrip 70 or cuff 72 with his hand or leg, respectively. Cable (or cables) 62 rotates around pulley (or pulleys) 74 when pulled during an exercise. Pulleys 72 are mounted on axle 76, which is journaled between plate 50 and D-strap 78 (FIG. 1). (or cables) is pulled, it rotates around pulleys 74 which are mounted on axle 76, which is journaled between the plate 50 and a D-strap 78 (FIG. 1). Resistance to the pulling on the free end of the cables 62, whether attached to the catch 68 or a hand grip 70 or cuff 72, is provided by the springs 80 which are mounted to the cross-brace 81 at the other end of the frame 12 (FIGS. 5 and 6). The springs 80 are detachably mounted to the cross-brace 81 on hooks 82. A number of hooks 82 are provided for a purpose which will be made clear below. Springs 80 are provided with a loop 85 at the other end which projects through holes (not numbered) in traveler 84. A pin 83 is provided to run through the loop(s) 85 inside traveler 84, thereby retaining traveler 84 on the end(s) of springs(s) 80. Traveler 84 could also be provided with hooks for attachment of the loop(s) 85. The cable 62 is anchored to the cross member 16 at the eyelet 90, runs over the pulley 88 and reverses direction to the pulley 74, which changes the direction of the cable 62 up to the pulley 64 and around to the catch 68, or a handgrip 70 or cuff 72, as described above. Additional resistance to the pulling of the free end of cable 62 can be provided by the addition of more springs 80 attached between the hooks 82 and the traveler 84. In a presently preferred embodiment, the resistance can be varied between the amount of resistance provided by the attachment of one spring between a hook 82 and a traveler 84 or as many as ten springs between the hooks 82 and two travelers 84. For purposes of clarity, only six springs are shown in FIG. 5.

Figure 7:
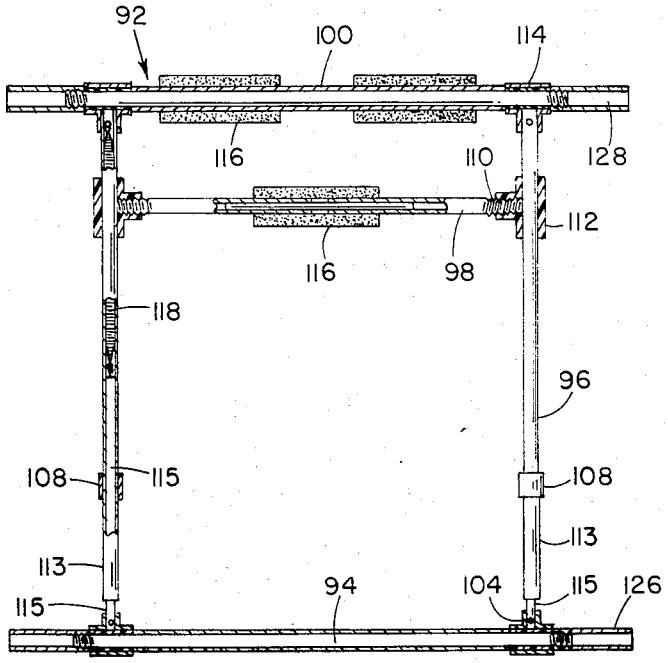
FIG. 7 is a cross-sectional view of the vertical resistance unit.

A vertical resistance unit, shown in FIGS. 1 and 7, is indicated generally at 92, and is comprised of a lower bar 94, uprights 96, a middle bar 98 and an upper bar 100. The lower bar 94 is retained within the groove 102 in the longitudinal members 14 by the bottom side of the first platform 18, and projects beyond both sides of the longitudinal members 14. The lower bar 94 is free to pivot in the groove 102. The uprights 96 are fixedly mounted to the lower bar 94 by the T-intersects 104. Support member 106, attached to the uprights 96 by bracket 108, is provided to retain the vertical resistance unit 92 in an upright position when not being held up by the user.

A middle bar 98 is provided with opposing threads 110, on either end, and the uprights 96 are provided with couplings 112 with mating opposing threads so that the middle bar 98 will be securely engaged against the uprights 96 by rotation of the middle bar 98 in one direction, and disengaged from the uprights 96 for movement of the middle bar up and down along the uprights 96 by rotation in the other direction. By rotating the middle bar 98 in one direction or the other and sliding the middle bar 98 upwardly or downwardly, the user can select a position along the upright 96 according to the user's size and/or the exercise desired to be performed.

The uprights 96 are securely mounted to the upper bar 100 by the T-intersects 114. Foam rubber padding 116 is provided in the middle of middle bar 98 and at two locations on the upper bar 100.

Contained within the uprights 96 are springs 118 (shown in the enlargement of FIG. 7), which provide resistance to upward movement of the middle bar 98 or the upper bar 100. The uprights 96 are comprised of an upper portion 113 and lower portion 115 in telescoping relationship, with the spring 118 fixed at the top of upper portion 113 and connected to the end of lower portion 115 by eyelets 121.

Figure 10:
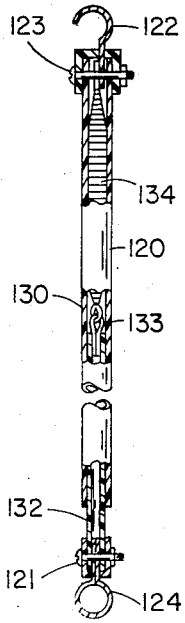
FIG. 10 is an elevational view of a resistor constructed according to the teachings of the present invention having a portion of the resistor broken away to show the internal construction.

Additional resistane to upward movement of the middle bar 98 and upper bar 100 can be provided by the addition of additional resistors 120 (FIGS. 1 ad 10). These resistors 120 are provided with a hook 122 at one end and an O-ring 124 at the other end. O-ring 124 is attached to resistor 120 by screw 121. The O-ring 124 is slipped over the protruding end 126 of the lower bar 94, and the hook 122 is slipped over the protruding end 128 of the upper bar 100. Like the uprights 96, each of the resistors 120 is, as shown in FIG. 10, comprised of a top portion 130 and a bottom portion 132 in telescoping relationship, and a spring 134 is anchored inside the resistor to provide resistance to the extension of the telescoped top 130 and bottom 132 portions of the resistor 120. The spring 134 is attached to the telescoping top 130 by screw 123. Spring 134 is attached to bottom portion 132 of resistor 120 by eyelets 133. In a presently preferred embodiment, the resistance to upward movement of the middle bar 98 and upper bar 100 may be varied between as little resistance as that provided by the springs 118 in the uprights 96 up to as much resistance as that which can be provided by the addition of as many resistors 120 as will fit on the protruding end 126 and the protruding end 128 of the lower bar 94 and the upper bar 100 respectively. For ease of storing and transport, the resistors 120 may be stored in position on the lower bar 94 and upper bar 100.

The apparatus of the present invention is capable of a great variety of exercises. With the second platform 20 in its first, horizontal position, a variety of exercises may be performed using the T-bar unit. These exercises are accomplished by detaching the free end of one of the cables 62 from the catch 68 and attaching a hand grip 70 or cuff 72 to the clip 66. Illustrative of the exercises which may be performed by pulling on the cable or the cables 62 include the following: leg adduction and abduction, bent arm fly, hip flexion, hip extension, and lat pulls. With the second platform 20 still in its horizontal, first position, the cable 62 is clipped to the catch 68 to enable the user to perform leg flexions.

With the cable 62 still clipped to the catches 68, the second platform 20 may be raised to its second, upright position, enabling the user to perform leg extensions. With the second platform in its horizontal first position, the vertical resistance unit allows the user to perform exercises such as resistance situps, the bench press, leg press, military press, triceps extension, biceps curl, knee lifts, and upright rowing.

A variety of other exercises are possible with the apparatus of the present invention, and in all cases, the maximum resistance is exerted throughout the full range of motion of each exercise. The middle bar 98 of the vertical resistance unit 92 is set upwardly or downwardly in a selected position according to the exercise which is desired to be performed. For instance, for a resistance situp, the user lies on his back on the first 18 and second 20 platforms, with his feet towards the T-bar unit 32, and adjusts the middle bar 98 downwardly on the uprights 96 until the foam padding 116 of the middle bar 98 engages the user's chest. The user then sits up by bending at the hips, and must overcome the upward resistance imposed by the springs 118 in the uprights 96 of the vertical resistance unit 92 as the lower bar 94 pivots in the groove 102 during the motion of the user. The middle bar 98 must be reset at a higher position along the upright 96 to allow the user to perform exercises such as the triceps extension. To perform this exercise, the user sits on the first platform 18 with his feet again towards the T-bar unit 32 and his shoulders approximately squared up with the uprights 96, and reaches up over his shoulders to grasp the middle bar 98 with his hands and then extends his arms by bending at the elbow. The user may also stand on the first platform 18, grasp the upper bar 100, and pull it upwards to perform an exercise such as the exercise known as upright rowing.

Although the invention has been described in terms of the foregoing preferred embodiment, changes in the details of the construction of this embodiment may be made by those skilled in the art who have the benefit of this disclosure. It is expected that all such changes to the details of the described embodiment will fall within the scope of the following claims.

What is claimed is:

1. An exercise machine comprising:

an elongate frame having a first platform mounted thereon;

a second platform pivotally mounted to said frame for pivoting between a first horizontal position and a second upright position;

a T-bar unit pivotally mounted to one end of said frame comprising support means for supporing said second platform in said second position, a support frame pivotally mounted to the support means, engagement means mounted to the support frame for engaging the foot of the user of said exercise machine for selectively pivoting the support frame with respect to the support means when said second platform is in said second position;

means having an end mounted to said frame and an end engaging the support frame of said T-bar unit for providing resistance to the pivoting of the support frame with respect to the support means;

an upright pivotally mounted to said frame comprising upper and lower portions in telescoping relationship and a horizontal bar integral with the upper portions thereof; and means for resisting the extension of the upper portions of said upright out of the lower portions of said upright.

2. The exercise machine of claim 1 wherein said means for resisting the pivoting of the support frame of said T-bar unit comprises a spring.

3. The exercise machine of claim 2 wherein said means for resisting the pivoting of the support frame additionally comprises a cable mounted to the end of said spring which is not mounted to said frame.

4. The exercise machine of claim 3 wherein additional resistance to the pivoting of the support frame of said T-bar unit is provided by detachably mounting additional springs between said frame and said cable.

5. The exercise machine of claim 3 wherein one end of said cable is mounted to said frame and said cable engages a pulley mounted on said spring.

6. The exercise machine of claim 1 wherein the support frame engage end of said means for resisting the pivoting of the support frame of said T-bar unit is detachably attached to the support frame.

7. The exercise machine of claim 6 wherein said means for resisting the pivoting of the support frame of said T-bar unit is provided with detachable means for engaging the hand of the user of said exercise machine when detached from the support frame.

8. The exercise machine of claim 1 wherein said upright is provided with a second horizontal bar.

9. The exercise machine of claim 1 wherein said upright is attached to a lower transverse bar which is pivotally mounted to said frame.

10. The exercise machine of claim 8 wherein said second horizontal bar is adjustably mounted to said upright below said integral horizontal bar.

11. The exercise machine of claim 9 wherein additional resistance to extension of the upper portion of said upright is provided by detachably mounting additional means for resisting extension of the upper portion of said upright between said lower transverse bar and said integral horizontal bar.

12. The exercise machine of claim 1 wherein said means for resisting extension of the upper portion of said upright comprises a spring.

13. The exercise machine of claim 12 wherein said spring is contained within said upright.

* * * * *